US007124828B2

(12) United States Patent
Jansch

(10) Patent No.: US 7,124,828 B2
(45) Date of Patent: Oct. 24, 2006

(54) APPARATUS FOR RETAINING TWO STRINGS OF TUBULARS

(75) Inventor: Manfred Jansch, Garbsen (DE)

(73) Assignee: Weatherford / Lamb, Inc., Houston, TX (US)

( * ) Notice: Subject to any disclaimer, the term of this patent is extended or adjusted under 35 U.S.C. 154(b) by 375 days.

(21) Appl. No.: 10/174,416

(22) Filed: Jun. 18, 2002

(65) Prior Publication Data

US 2004/0040701 A1 Mar. 4, 2004

Related U.S. Application Data

(63) Continuation of application No. 09/530,197, filed as application No. PCT/GB98/03198 on Oct. 27, 1998, now Pat. No. 6,422,311.

(30) Foreign Application Priority Data

Oct. 28, 1997 (DE) ..... 197 47 468

(51) Int. Cl.
*E21B 33/047* (2006.01)

(52) U.S. Cl. ..... 166/382; 166/75.14; 166/85.1; 166/88.4; 166/97.5; 166/208

(58) Field of Classification Search ..... 166/382, 166/77.1, 77.2, 77.51–77.53, 77.4, 208, 241.6, 166/65.1, 85.5, 88.1, 89.1–89.3, 88.2, 88.4, 166/75.14, 97.5, 206, 242.3, 385, 85.1
See application file for complete search history.

(56) References Cited

U.S. PATENT DOCUMENTS

| | | | | |
|---|---|---|---|---|
| 1,541,669 A | | 6/1925 | Summers | |
| 2,063,361 A | | 12/1936 | Baash | 24/263 |
| 2,298,507 A | | 10/1942 | Penick et al. | 24/263 |
| 2,589,159 A | | 3/1952 | Stone | 255/23 |
| 2,934,148 A | | 4/1960 | Allaire | 166/75 |
| 3,188,708 A | | 6/1965 | O'Haver | 24/263 |
| 3,287,776 A | | 11/1966 | Brown | 24/81 |
| 3,330,354 A | | 7/1967 | Chamblee | 166/46 |
| 3,740,801 A | * | 6/1973 | Sears et al. | 166/241.7 |
| 3,748,702 A | | 7/1973 | Brown | 24/263 |
| 3,757,387 A | * | 9/1973 | Bush et al. | 166/241.7 |
| 3,907,338 A | * | 9/1975 | Hayes et al. | 254/228 |
| 4,090,565 A | * | 5/1978 | McGee | 166/379 |
| 4,354,706 A | | 10/1982 | Coyle, Sr. | 294/102 A |
| 4,381,584 A | | 5/1983 | Coyle, Sr. | 24/263 D |
| 4,422,504 A | * | 12/1983 | Moore | 166/241.7 |
| 4,523,645 A | | 6/1985 | Moore | 166/385 |

(Continued)

FOREIGN PATENT DOCUMENTS

FR 2 658 972 8/1991

OTHER PUBLICATIONS

PCT International Preliminary Examination Report issued for application Ser. No. PCT/GB98/03198, Dated Jan. 19, 2000.

(Continued)

*Primary Examiner*—Zakiya W. Bates
(74) *Attorney, Agent, or Firm*—Patterson & Sheridan, LLP

(57) ABSTRACT

An apparatus for retaining two strings of tubulars characterized in that the apparatus comprises body parts of a device for retaining a single string of tubulars and a converting member. A device for retaining a string of tubulars, the device comprising at least one body part having a curved tapered surface upon which inserts are located for engagement with the string of tubulars characterised in that the curved tapered surface comprises a recess for the passage of cables.

92 Claims, 5 Drawing Sheets

U.S. PATENT DOCUMENTS

| | | | | | |
|---|---|---|---|---|---|
| 4,543,998 | A | * | 10/1985 | Thomerson | 138/110 |
| 4,600,054 | A | | 7/1986 | Miller et al. | 166/75.1 |
| 4,603,737 | A | * | 8/1986 | Spikes | 166/241.7 |
| 4,643,259 | A | | 2/1987 | Zeringue, Jr. | 166/77.5 |
| 4,697,830 | A | * | 10/1987 | Wood et al. | 285/27 |
| 4,715,456 | A | | 12/1987 | Poe, Jr. et al. | 175/423 |
| 4,867,236 | A | | 9/1989 | Haney et al. | 166/77.5 |
| 5,335,756 | A | | 8/1994 | Penisson | 188/67 |
| 5,379,836 | A | * | 1/1995 | Jordan | 166/241.6 |
| 5,484,040 | A | | 1/1996 | Penisson | 188/67 |
| 5,609,226 | A | | 3/1997 | Penisson | 188/67 |
| 5,848,647 | A | | 12/1998 | Webre et al. | 166/379 |
| 6,023,027 | A | * | 2/2000 | Neff | 174/136 |
| 6,089,338 | A | | 7/2000 | Bouligny, Jr. | 175/423 |

OTHER PUBLICATIONS

PCT International Search Report issued for application Ser. No. PCT/GB98/03198, Dated Dec. 18, 1998.

* cited by examiner

APPARATUS FOR RETAINING TWO STRINGS OF TUBULARS

This is a continuation of application Ser. No. 09/530,197 filed on Apr. 25, 2000, now U.S. Pat. No. 6,422,311, which is the National Stage of International Application No. PCT/GB98/03198, filed on Oct. 27, 1998, which application and patent are herein incorporated by reference in their entirety.

The invention relates to an apparatus for retaining two strings of tubulars, and is particularly but not exclusively for use as a spider in the platform of an oil rig and also for use in an elevator of an oil rig. The invention also relates to a device for retaining a string of tubulars the device comprising at least one body part having a curved tapered surface upon which inserts are located for engagement with the string of tubulars.

In the formation and operation of oil or gas wells it is desirable to lower a string of tubulars into the well. For this purpose, a retaining device is used in a platform of the rig, known as a spider, and a corresponding retaining device in an elevator of the rig. The string of tubulars is initially retained from falling down the well by the spider. Additional stands of tubulars are moved from a rack to a position above the spider. The stand of tubulars is connected to the string. The device in the elevator is placed around the top of the lengthened string of tubulars. The spider is then released from engagement with the string, and the device in the elevator now takes the full weight of the lengthened string of tubulars. The elevator moves downwardly towards the spider, lowering the lengthened string of tubulars. The spider engages the lengthened string of tubulars and the elevator is subsequently released from engagement therewith. This process is reversed for pulling a string of tubulars out of a well.

It is often desired to lower two substantially parallel strings of tubulars simultaneously, such as a delivery pipe and an injection pipe used in the forced extraction of oil or gas from a well or used in trial wells.

A problem associated with prior art devices is that their construction is large, expensive and can only be used for retaining two strings of tubular.

Accordingly there is provided an apparatus for retaining two strings of tubulars characterised in that said apparatus comprises body parts of a device for retaining a single string of tubulars and a converting member.

Other features and aspects of the present invention are set out in claims 2 to 9.

There is also provided a device for retaining a string of tubulars, said device comprising at least one body part having a curved tapered surface upon which inserts are located for engagement with said string of tubulars characterised in that said curved tapered surface comprises a recess for the passage of cables.

For a better understanding of the present invention, reference will now be made, by way of example, to the accompanying drawings, in which.

Figure 1:
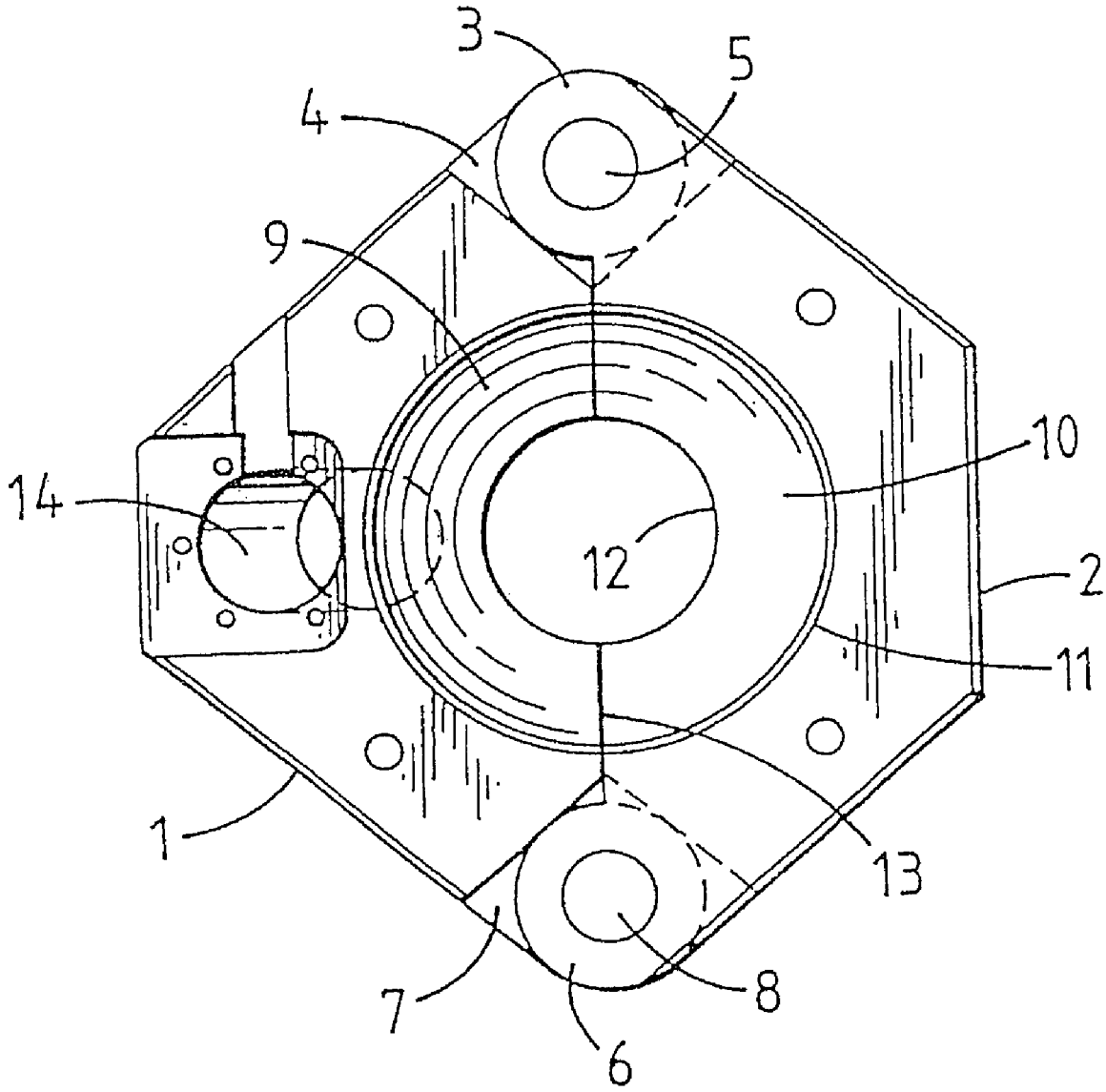
FIG. 1 (PRIOR ART)
FIG. 1 is a top plan view of a prior art device for retaining a single string of tubulars.

Referring to FIG. 1 there is shown a prior art device for retaining a single string of tubulars. The device comprises two body parts 1 and 2. The body parts 1 and 2 are generally triangular in shape and are hinged in relation to one another by means of inter engaging rows of eyelets 3 and 4 and a hinge pin 5 at one corner thereof. Each row of eyelets 3 and 4 is integral with the respective body part 1 and 2. The body parts 1 and 2 also have inter engaging rows of eyelets 6 and 7 on the opposite corners thereof. The body parts 1 and 2 may be locked together by use of a locking pin 8 insertable through the rows of eyelets 6 and 7.

The body parts 1 and 2 are provided with semicircular tapered surfaces 9 and 10 which taper downwardly from a first diameter 11 to a second smaller diameter 12. In use, corresponding tapered inserts (not shown) are provided on the tapered surface for gripping the tubular which runs therethrough. The weight of the tubular string will be transferred from the tapered inserts to the tapered surfaces 9 and 10.

A gap 13 is provided between the body parts 1 and 2. Body part 1 also comprises an opening 14 which runs from the top to the bottom of the body part 1 and lies parallel to the tapered surface 9. The opening 14 is provided for receiving an actuating piston and cylinder (not shown) which, in use, moves the tapered inserts along the tapered surfaces 9 and 10 for engaging or disengaging the inserts with a tubular. The actuating piston and cylinder may be hydraulic or pneumatic.

In use, two such devices are used. One device is mounted in an elevator and the other is mounted in the floor of an oil rig. A string of tubulars, such as casing, is first retained in the device mounted in the floor of the oil rig. A section of casing may then be added or taken away from the string of casing thereabove. This may be achieved by using tubular handling equipment to move the section of casing to a position above the string of casing, and a tong to facilitate connection or disconnection of the section of casing to or from the string of casing. The device mounted in the elevator may now be used to retain the section of casing extending above the device in the floor of the oil rig. The device in the floor of the oil rig may now be disengaged from the string of tubulars. The elevator is then operated to lower or raise the entire string of casing. The device in the rig floor is then used to retain the string of casing once again.

Referring to FIGS. 2 to 6 there is shown an apparatus for retaining two strings of tubulars, the apparatus being in accordance with the invention. The apparatus is generally identified by the reference numeral 100.

The apparatus 100 comprises body part 101 which is generally similar to body part 1 of FIG. 1, body part 102 which a mirror image of the body part 1 of FIG. 1 and a converting member 103.

Figure 6:
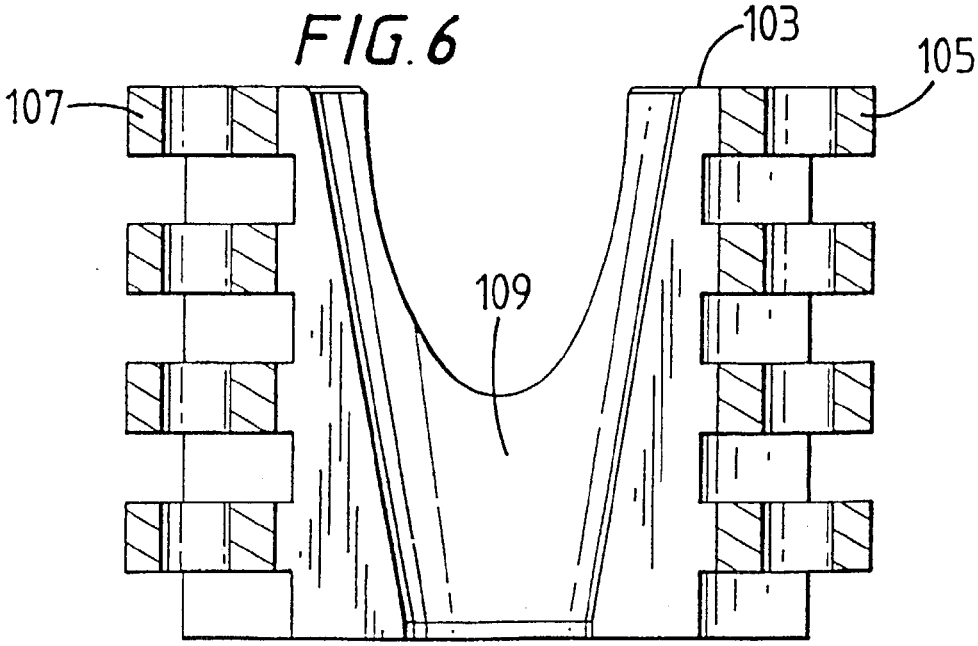
FIG. 6 is a cross sectional view of the part of the apparatus of FIG. 4 taken along the line VI—VI.

The converting member 103 is generally rectangular in shape with rows of eyelets 104,105,106,107 at each corner thereof. The converting member is provided with two semicircular tapered surfaces 108,109 which taper downwardly from a first diameter 110 to a smaller diameter 111. The semicircular tapered surfaces 108,109 oppose each other and merge as the diameter increases from the smaller diameter to the first diameter as shown in FIG. 6. In use, corresponding tapered inserts (not shown) are provided on the tapered surfaces 108,109 for gripping a tubular.

The converting member 103 is arranged between the body parts 101 and 102 and are hinged thereto. A row of eyelets 112 is integral with one corner of the body part 101 and inter engages with the row of eyelets 104 of the converting member 103 and a hinge pin 113 is located therethrough. A row of eyelets 114 is integral with a first corner of the body part 102 and inter engages with the row of eyelets 105 of the converting member 103 and a hinge pin 115 is located therethrough. A row of eyelets 116 is integral with an opposing corner of body part 101 and inter engages with a row of eyelets 106 of the converting member 103 and a locking pin 117 may be inserted therethrough to lock the body part 101 to the converting member 103. A row of eyelets 118 is integral with an opposing corner of body part 102 and inter engages with the row of eyelets 107 of the converting member 103 and a locking pin 119 may be inserted therethrough to lock the body part 102 to the converting member 103.

Each of the body parts 101 and 102 are provided with corresponding tapered surfaces 120 and 121 and with openings 122 and 123 for receiving actuating pistons and cylinders as described with reference to the device of FIG. 1.

In use, two such apparatuses are used, one as a spider in the platform of an oil rig and the other in the elevator of the oil rig. The method of operation is much the same as that described with reference to the device of FIG. 1, except that two actuating pistons and cylinders are used to move the tapered inserts along the tapered surfaces 108,109,120 and 121 for engaging or disengaging the inserts with a tubular.

Figure 7:
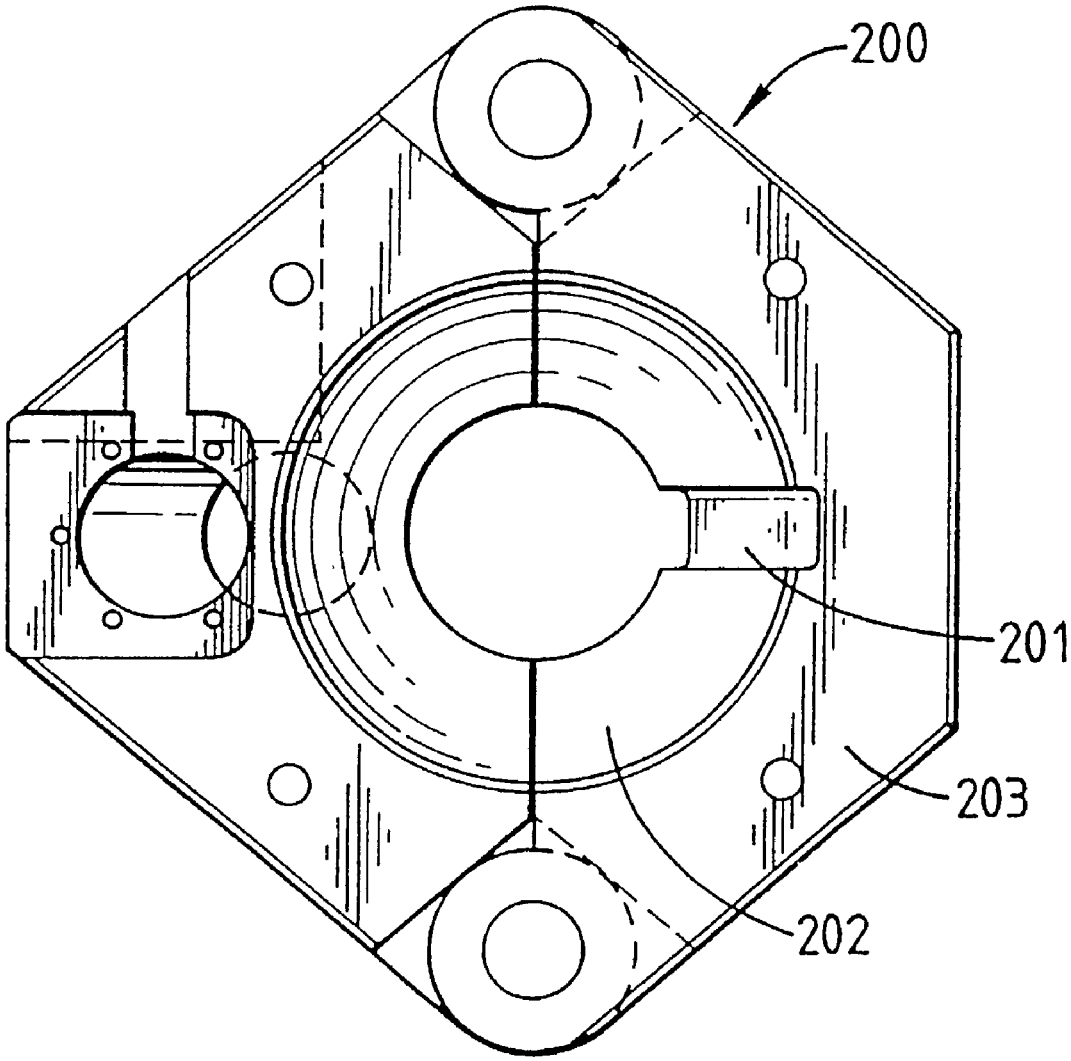
FIG. 7 is a top plan view of an apparatus for retaining a single string of tubulars, the apparatus being in accordance with a second aspect of the invention.

Referring now to FIG. 7 there is shown a device, generally identified by reference numeral 200.

The device 200 is generally similar to the device shown in FIG. 1 with the additional feature of a recess 201 in the tapered surface 202 of the body part 203. The recess 201 is sized to accommodate a loom of cables running substantially parallel to the string of tubulars. This enables the cable strings to pass through the device for retaining a string of tubulars, for example, through a spider.

Figure 8:
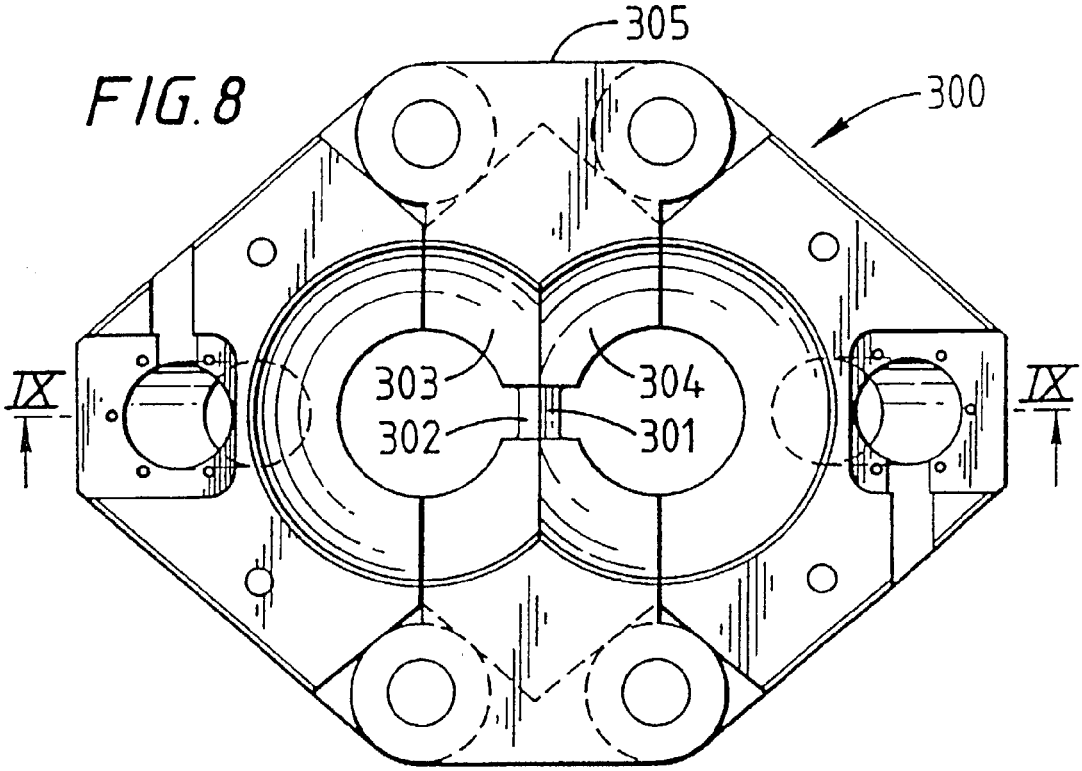
FIG. 8 is a top plan view of an alternative apparatus for retaining two strings of tubulars, the apparatus being in accordance with the first and second aspects of the invention.
Figure 9:
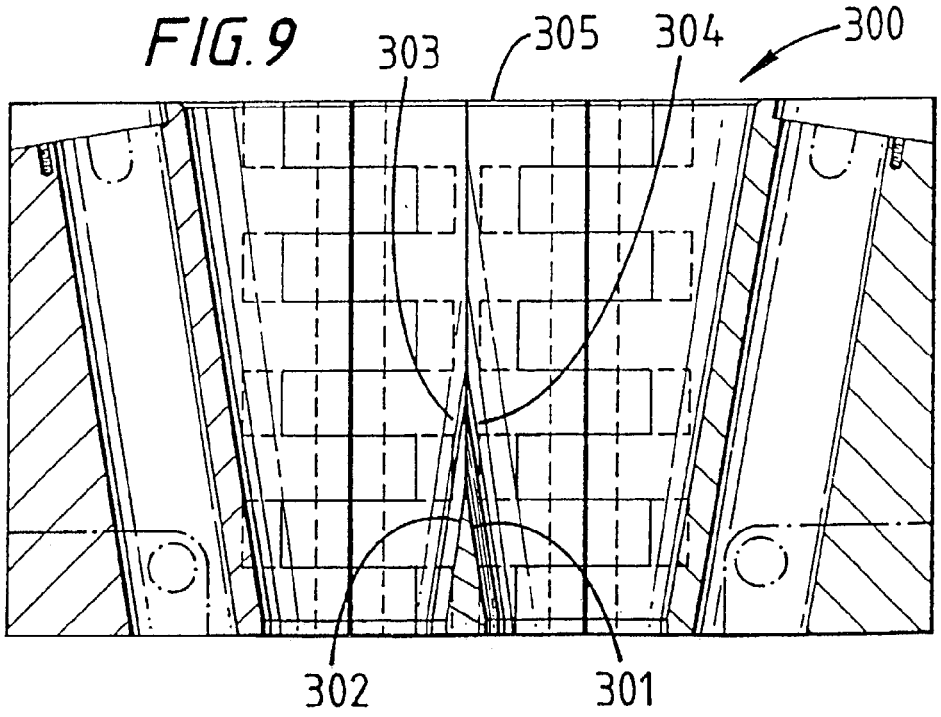
FIG. 9 is a cross sectional view of the apparatus of FIG. 8 taken along the line IX—IX.

FIGS. 8 and 9 shows an apparatus generally identified by reference numeral 300.

Figure 2:
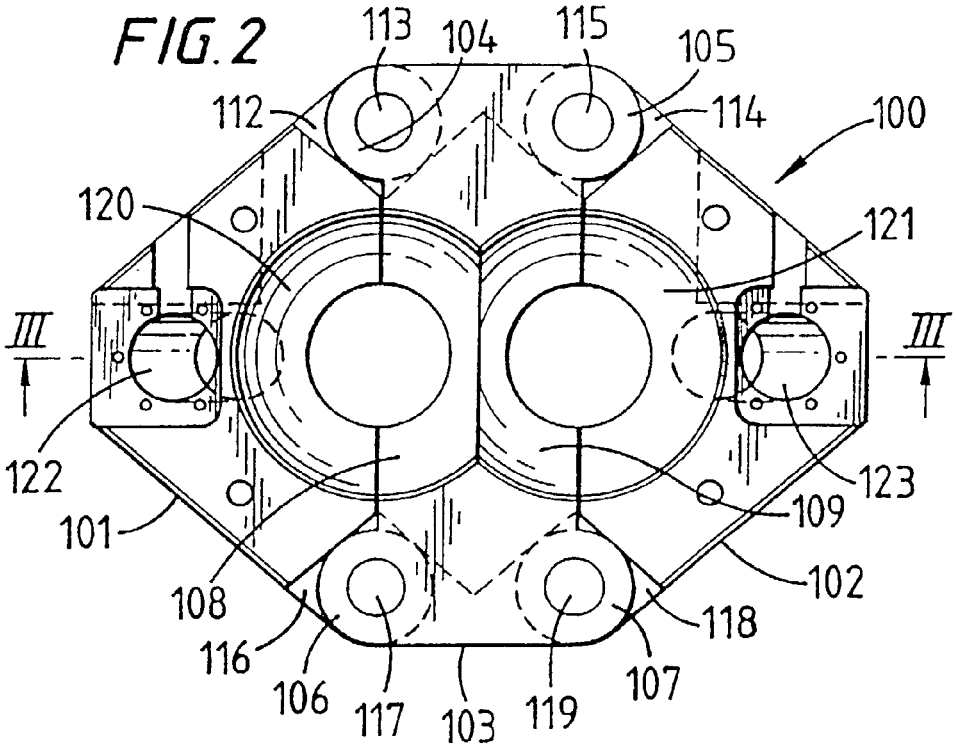
FIG. 2 is a top plan view of an apparatus for retaining two strings of tubulars, the apparatus being in accordance with a first aspect of the invention.
Figure 3:
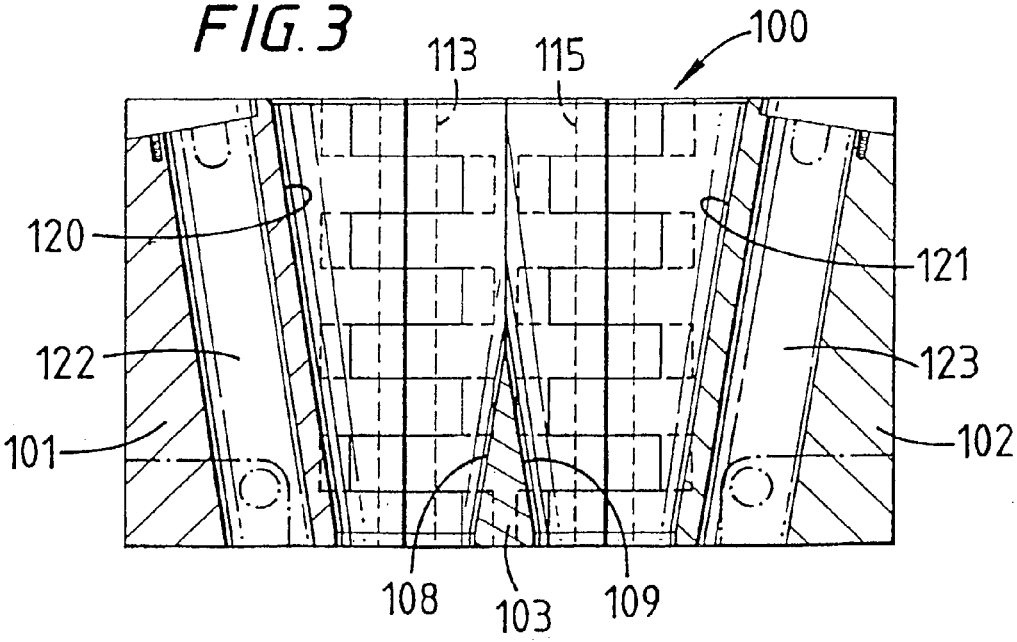
FIG. 3 is a cross sectional view of the apparatus of FIG. 2 taken along the line III—III.
Figure 4:
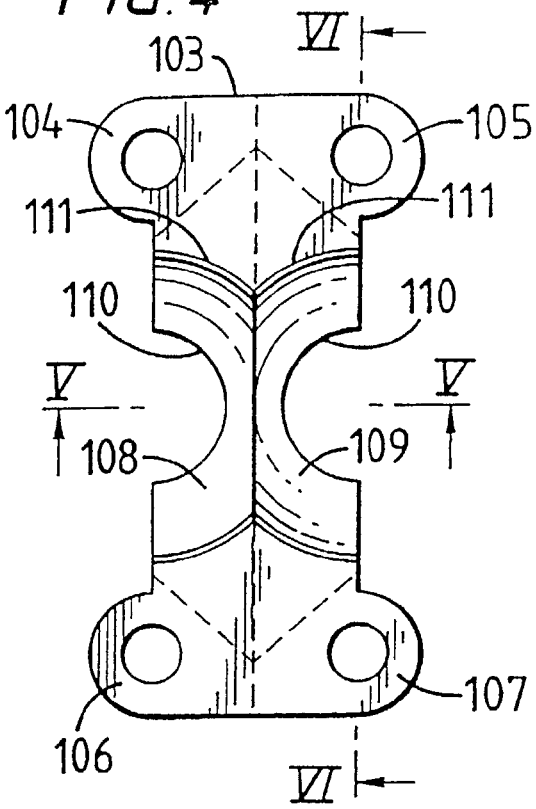
FIG. 4 is a top plan view of part of the apparatus of FIG. 2.
Figure 5:
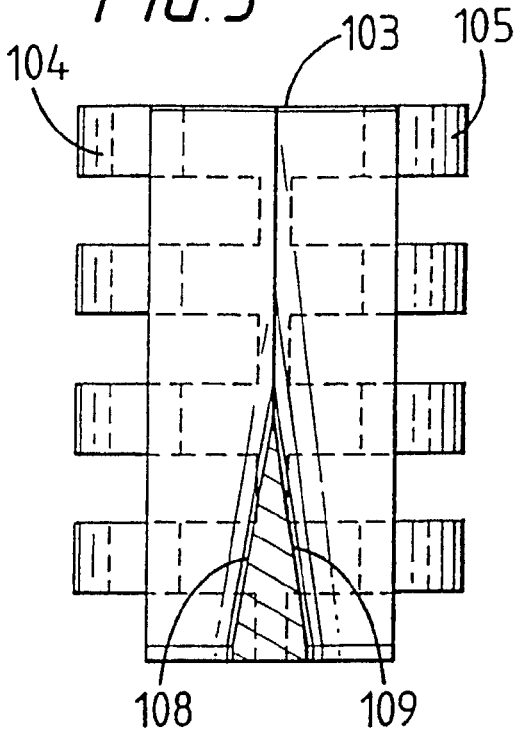
FIG. 5 is a cross sectional view of the part of the apparatus of FIG. 4 taken along the line V—V.

The device 300 is generally similar to the apparatus 100 of FIG. 2 with the additional feature of a recess 301 and 302 in each of the tapered surface 303 and 304 of the converting member 305. The recesses 301 and 302 are sized to accommodate a loom of cables running substantially parallel to the two strings of tubulars. This enables the cable strings to pass through the device for retaining a string of tubulars, for example, through a spider.

It is envisaged that the apparatuses could be used for coiled tubing, as well as tool strings, strings of drill pipe, casing and liners.

What is claimed is:

1. An apparatus for retaining a tubular, comprising:

a first passage and a second passage, wherein the first passage is larger than the second passage and the first passage having gripping members movable in the first passage adapted to retain the tubular and wherein the second passage is a recess formed in a wall of the first passage and is substantially parallel to the first passage.

2. The apparatus of claim 1, wherein the first passage is in communication with the second passage.

3. The apparatus of claim 1, wherein the second passage is adapted to maintain a string.

4. The apparatus of claim 3, wherein the string comprises a cable.

5. The apparatus of claim 1, wherein the gripping member is at least partially disposed in the first passage.

6. The apparatus of claim 1, wherein the first passage comprises a tapered surface.

7. The apparatus of claim 6, wherein the gripping members are movable along the tapered surface.

8. The apparatus of claim 6, where the taper surface extends along substantially the full length of the first passage.

9. The apparatus of claim 1, wherein the second passage is adapted to allow a cable disposed exterior to the tubular to pass through the apparatus.

10. The apparatus of claim 1, further comprising a first body part and a second body part, wherein the first body part and the second body part are adapted to retain a tubular.

11. The apparatus of claim 8, wherein the first body part and the second body part are operatively coupled together.

12. The apparatus of claim 8, wherein the first body part and the second body part are hinged on at least one side.

13. The apparatus of claim 8, wherein the first body part and the second body part may be opened on two sides.

14. The apparatus of claim 1, wherein the gripping members comprise slips.

15. The apparatus of claim 1, wherein the apparatus comprises a spider.

16. The apparatus of claim 1, wherein the apparatus comprises an elevator.

17. The apparatus of claim 1, wherein the tubular is one of coiled tubing, tool string, drill pipe, casing, and liner.

18. The apparatus of claim 1, wherein the gripping members are radially movable.

19. The apparatus of claim 18, wherein the gripping members comprise at least one insert.

20. The apparatus of claim 19, wherein the second passage is adapted to maintain a cable.

21. A method of retaining a tubular and at least one connection member, comprising:

providing a tubular handling apparatus having gripping members, a first passage, and a second passage, wherein the second passage is a recess formed in a wall of the first passage;

moving the gripping members in the first passage to retain at least a portion of the tubular in the first passage;

passing the at least one connection member through the second passage; and running the at least one connection member substantially parallel to the tubular in the first passage.

22. The method of claim 12, wherein the at least one connection member comprises a cable.

23. The method of claim 12, wherein the tubular handling apparatus comprises a first body part and a second body part, the first body part and the second body part adapted to engage the tubular.

24. The method of claim 12, wherein the first passage comprises a tapered surface.

25. The method of claim 24, wherein the gripping members are moved along the tapered surface.

26. The method of claim 12, further comprising opening one side of the tubular handling apparatus to retain the tubular.

27. The method of claim 16, further comprising opening another side of the tubular handling apparatus to release the tubular.

28. The method of claim 21, wherein the tubular handling apparatus comprises a spider.

29. The method of claim 21, wherein the at least one transmission member comprises a cable.

30. An apparatus for retaining a tubular, comprising:

a first body part and a second body part, wherein the first body part and the second body part are operatively coupled together to retain and support a weight of the tubular, and wherein the first body part and the second body part are openable on two sides to receive the tubular; and a first passage and a second passage, wherein the first passage is formed by coupling the first body part and the second body part and wherein the second passage maintains.

31. The apparatus of claim 18, wherein the first passage is in communication with the second passage.

32. The apparatus of claim 18, wherein the second passage is a recess formed in a wall of the first passage.

33. The apparatus of claim 18, wherein the string comprises a cable.

34. The apparatus of claim 30, wherein the apparatus comprises a spider.

35. A method for retaining a tubular and at least one transmission member in a wellbore, comprising:

providing a tubular handling apparatus having a first passage and a second passage;

installing the tubular handling apparatus on a rig floor;

retaining a portion of the tubular in the first passage; and passing the at least one transmission member through the second passage.

36. The method of claim 22, further comprising connecting a tubular section to the tubular, thereby forming an extended tubular.

37. The method of claim 23, further comprising releasing the extended tubular from the tubular handling apparatus.

38. The method of claim 24, further comprising:

lowering the extended tubular; and retaining the extended tubular in the first passage.

39. The method of claim 22, wherein the tubular handling apparatus comprises a first body part and a second body part, the first body part and the second body part adapted to engage the tubular.

40. The method of claim 22, wherein the first passage comprises a tapered surface.

41. The method of claim 22, wherein the first passage comprises one or more gripping members.

42. The method of claim 22, wherein axial movement of the tubular in the wellbore is limited when it is retained by the tubular handling apparatus.

43. The method of claim 22, further comprising extending a length of the transmission member.

44. The method of claim 22, further comprising running the transmission member substantially parallel to the tubular.

45. The method of claim 38, further comprising extending a length of the transmission member.

46. The method of claim 38, further comprising running the transmission member substantially parallel to the tubular.

47. The method of claim 35, wherein retaining the tubular comprises moving a gripping member into engagement with the tubular.

48. The method of claim 47, wherein the gripping member is radially movable.

49. The method of claim 48, wherein the gripping member comprises an insert.

50. The method of claim 35, wherein the at least one transmission member comprises a fluid line.

51. The method of claim 35, wherein the at least one transmission member comprises a control line.

52. An apparatus for retaining a tubular, comprising:

a first passage and a second passage, wherein the first passage is larger than the second passage and the first passage retains and supports a weight of the tubular and wherein the second passage is a recess formed in a wall of the first passage and is adapted to maintain a string.

53. The apparatus of claim 34, wherein the first passage is in communication with the second passage.

54. The apparatus of claim 34, wherein the string comprises a cable.

55. The apparatus of claim 34, further comprising a tubular gripping member at least partially disposed in the first passage.

56. The apparatus of claim 34, wherein the first passage is tapered.

57. The apparatus of claim 34, wherein the second passage is adapted to allow a cable disposed exterior to the tubular to pass through the apparatus.

58. The apparatus of claim 34, further comprising a first body pad and a second body part, wherein the first body part and the second body pad are adapted to retain a tubular.

59. The apparatus of claim 40, wherein the first body part and the second body part are operatively coupled together.

60. The apparatus of claim 52, wherein the string comprises a control line.

61. The apparatus of claim 60, wherein the control line comprises a cable.

62. The apparatus of claim 61, wherein the tubular is one of coiled tubing, tool, string, drill pipe, casing, and liner.

63. The apparatus of claim 60, further comprising an insert for engaging the tubular.

64. The apparatus of claim 52, further comprising an insert for engaging the tubular.

65. The apparatus of claim 64, wherein the insert is movable in the first passage.

66. The apparatus of claim 65, wherein the insert is tapered.

67. The apparatus of claim 65, wherein the insert is radially movable.

68. The apparatus of claim 67, wherein the string comprises a control line.

69. The apparatus of claim 68, wherein the tubular comprises a casing.

70. A method of retaining a tubular and at least one connection member, comprising;

providing a tubular handling apparatus having a first passage and a second passage, wherein the second passage is a recess formed in a wall of the first passage;

retaining a portion of the tubular in the first passage;

supporting a weight of the tubular on the tubular handling apparatus; and passing the at least one connection member through the second passage, wherein the at least one connection member comprises a cable.

71. The method of claim 59, further comprising lowering the tubular into a wellbore.

72. An apparatus for retaining a tubular in a wellbore, comprising:

a first body part and a second body part operatively coupled together for retaining the wellbore tubular and adapted to open on at least one side to receive the tubular;

a first passage defined by the first body part and the second body part adapted to retain the tubular and allow the tubular to pass;

at least one movable gripping member disposed in the first passage for engaging the wellbore tubular; and a second passage adapted to retain a transmission member and allow the transmission member to pass, wherein the first passage is larger than the second passage and wherein the second passage extends substantially parallel to the first passage and is in communication with the first passage.

73. The apparatus of claim 72, wherein the transmission member runs substantially parallel to the wellbore tubular.

74. The apparatus of claim 72, wherein the first passage comprises one or more tapered surfaces.

75. The apparatus of claim 74, wherein the at least one movable gripping member disposed on the one or more tapered surfaces.

76. The apparatus of claim 43, wherein the apparatus comprises a spider.

77. The apparatus of claim 43, wherein the apparatus comprises an elevator.

78. The apparatus of claim 43, wherein the second passage is disposed exterior to the first passage.

79. The apparatus of claim 72, wherein the transmission member comprises a delivery pipe.

80. The apparatus of claim 72, wherein the transmission member comprises an injection pipe.

81. The apparatus of claim 72, wherein the at least one gripping members comprise at least one slips.

82. An apparatus for retaining a tubular in a wellbore, comprising:

a first body part and a second body part operatively coupled together for retaining the tubular and adapted to open on at least one side to receive the tubular;

a first passage defined by the first body part and the second body part adapted to retain the tubular and allow the tubular to pass; and a second passage adapted to retain a transmission member and allow the transmission member to pass, wherein the first passage is larger than the second passage and wherein the second passage extends substantially parallel to the first passage, wherein the apparatus comprises a spider.

83. An apparatus for retaining a tubular in a wellbore, comprising:

a first body part and a second body part operatively coupled together for retaining the tubular and adapted to open on at least one side to receive the tubular;

a first passage defined by the first body part and the second body pad adapted to retain the tubular and allow the tubular to pass; and a second passage adapted to retain a transmission member and allow the transmission member to pass, wherein the first passage is larger than the second passage and wherein the second passage extends substantially parallel to the first passage, wherein the apparatus comprises an elevator.

84. A method of retaining a tubular and at least one connection member, comprising:

providing a spider having a first passage and a second passage, wherein the second passage is a recess formed in a wall of the first passage;

retaining a portion of the tubular in the first passage; and passing the at least one connection member through the second passage.

85. The method of claim 84, wherein the at least one connection member comprises a cable.

86. The method of claim 85, wherein retaining the tubular comprises moving a gripping member into engagement with the tubular.

87. The method of claim 86, wherein the tubular is one of coiled tubing, tool string, drill pipe, casing, and liner.

88. The method of claim 87, wherein the gripping member comprises an insert.

89. The method of claim 86, wherein moving the gripping member comprises moving the gripping member along a tapered surface of the first passage.

90. The method of claim 84, wherein the at least one connection member comprises a fluid line.

91. The method of claim 84, wherein the at least one connection member comprises a control line.

92. The method of claim 84, wherein the tubular is one of coiled tubing, tool string, drill pipe, casing, and liner.

* * * * *

UNITED STATES PATENT AND TRADEMARK OFFICE

CERTIFICATE OF CORRECTION

PATENT NO. : 7,124,828 B2
APPLICATION NO. : 10/174416
DATED : October 24, 2006
INVENTOR(S) : Manfred Jansch It is certified that error appears in the above-identified patent and that said Letters Patent is hereby corrected as shown below:

In column 4, Claim 11, line 20, please delete [8] and insert --10--.

In column 4, Claim 12, line 22, please delete [8] and insert --10--.

In column 4, Claim 13, line 24, please delete [8] and insert --10--.

In column 4, Claim 22, line 52, please delete [12] and insert --21--.

In column 4, Claim 23, line 54, please delete [12] and insert --21--.

In column 4, Claim 24, line 58, please delete [12] and insert --21--.

In column 4, Claim 26, line 62, please delete [12] and insert --21--.

In column 4, Claim 27, line 65, please delete [16] and insert --26--.

In column 5, Claim 29, lines 3-4, please delete [the at least one transmission member comprises a cable] and insert --the gripping members comprise slips--.

In column 5, Claim 30, line 15, after the word “maintains” insert --a string--.

In column 5, Claim 31, line 16, please delete [18] and insert --30--.

In column 5, Claim 32, line 18, please delete [18] and insert --30--.

In column 5, Claim 33, line 20, please delete [18] and insert --30--.

In column 5, Claim 35, line 25, please delete [in a wellbore].

In column 5, Claim 36, line 32, please delete [22] and insert --35--.

In column 5, Claim 37, line 35, please delete [23] and insert --36--.

In column 5, Claim 38, line 37, please delete [24] and insert --37--.

In column 5, Claim 39, line 40, please delete [22] and insert --35--.

In column 5, Claim 40, line 44, please delete [22] and insert --35--.

UNITED STATES PATENT AND TRADEMARK OFFICE

CERTIFICATE OF CORRECTION

PATENT NO. : 7,124,828 B2
APPLICATION NO. : 10/174416
DATED : October 24, 2006
INVENTOR(S) : Manfred Jansch It is certified that error appears in the above-identified patent and that said Letters Patent is hereby corrected as shown below:

In column 5, Claim 41, line 46, please delete [22] and insert --35--.

In column 5, Claim 42, line 48, please delete [22] and insert --35--.

In column 5, Claim 43, line 51, please delete [22] and insert --35--.

In column 5, Claim 44, line 53, please delete [22] and insert --35--.

In column 5, Claim 45, lines 56-57, please delete [38, further comprising extending a length of the transmission member] and insert --35, wherein the tubular handling apparatus comprises a spider.--.

In column 5, Claim 46, lines 58-60, please delete [38, further comprising running the transmission member substantially parallel to the tubular] and insert --45, wherein the at least one transmission member comprises a cable.--.

In column 6, Claim 53, line 11, please delete [34] and insert --52--.

In column 6, Claim 54, line 13, please delete [34] and insert --52--.

In column 6, Claim 55, line 15, please delete [34] and insert --52--.

In column 6, Claim 56, line 18, please delete [34] and insert --52--.

In column 6, Claim 57, line 20, please delete [34] and insert --52--.

In column 6, Claim 58, line 23, please delete [34] and insert --52--.

In column 6, Claim 58, line 24, please delete [pad] and insert --part--.

In column 6, Claim 58, line 25, please delete [pad] and insert --part--.

In column 6, Claim 59, line 26, please delete [40] and insert --58--.

UNITED STATES PATENT AND TRADEMARK OFFICE

CERTIFICATE OF CORRECTION

PATENT NO. : 7,124,828 B2
APPLICATION NO. : 10/174416
DATED : October 24, 2006
INVENTOR(S) : Manfred Jansch It is certified that error appears in the above-identified patent and that said Letters Patent is hereby corrected as shown below:

In column 6, Claim 62, line 33, between "tool" and "string", please delete the comma [,].

In column 6, Claim 71, line 60, please delete [59] and insert --70--.

In column 6, Claim 72, line 62, please delete [tubular in a wellbore] and insert --wellbore tubular--.

In column 7, Claim 76, line 19, please delete [43] and insert --72--.

In column 7, Claim 77, line 21, please delete [43] and insert --72--.

In column 7, Claim 78, line 23, please delete [43] and insert --72--.

In column 8, Claim 83, line 7, please delete [pad] and insert --part--.

Signed and Sealed this

Twelfth Day of August, 2008

JON W. DUDAS
*Director of the United States Patent and Trademark Office*